US007081028B1

(12) United States Patent
Crane

(10) Patent No.: US 7,081,028 B1
(45) Date of Patent: Jul. 25, 2006

(54) PORTABLE CONTROL DEVICE USED AS A SECURITY AND SAFETY COMPONENT OF A MARINE PROPULSION SYSTEM

(75) Inventor: John C. Crane, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 18 days.

(21) Appl. No.: 10/861,565

(22) Filed: Jun. 4, 2004

(51) Int. Cl.
*B60W 10/04* (2006.01)

(52) U.S. Cl. ..... 440/84

(58) Field of Classification Search ..... 440/1, 440/2, 84, 87; 340/5.72
See application file for complete search history.

(56) References Cited

U.S. PATENT DOCUMENTS

| | | | | |
|---|---|---|---|---|
| 3,786,892 | A | 1/1974 | Horton | 180/99 |
| 3,889,089 | A | 6/1975 | Tomlin | 200/334 |
| 5,229,648 | A | 7/1993 | Sues et al. | 307/10.2 |
| 5,396,215 | A | 3/1995 | Hinkle | 340/426 |
| 5,838,227 | A | 11/1998 | Murray | 340/425.5 |
| 6,091,330 | A | 7/2000 | Swan et al. | 340/539 |
| 6,140,935 | A | 10/2000 | Hayton et al. | 340/825.31 |
| 6,144,112 | A | 11/2000 | Gilmore | 307/10.2 |
| 6,150,928 | A | 11/2000 | Murray | 340/426 |
| 6,352,045 | B1 * | 3/2002 | Takashima | 114/55.5 |
| 6,450,845 | B1 | 9/2002 | Snyder et al. | 440/1 |
| 6,476,708 | B1 | 11/2002 | Johnson | 340/10.34 |
| 6,566,997 | B1 | 5/2003 | Bradin | 340/10.2 |
| 6,650,227 | B1 | 11/2003 | Bradin | 340/10.3 |
| 6,812,829 | B1 * | 11/2004 | Flick | 340/426.13 |
| 2004/0239483 | A1 * | 12/2004 | Flick et al. | 340/5.72 |

* cited by examiner

*Primary Examiner*—Ed Swinehart
(74) *Attorney, Agent, or Firm*—William D. Lanyi

(57) ABSTRACT

An engine control system for a marine propulsion system uses a portable control device that is configured to emit first and second signals that are receivable by first and second sensors. The first signal relates to the starting of the engine of the marine propulsion system by the operator. The second signal relates to the presence of the operator, wearing the portable control device, within a predescribed zone surrounding the second sensor near the helm position.

20 Claims, 3 Drawing Sheets

PORTABLE CONTROL DEVICE USED AS A SECURITY AND SAFETY COMPONENT OF A MARINE PROPULSION SYSTEM

BACKGROUND OF THE INVENTION

1. Field of the Invention

The preferred embodiment of the present invention is generally related to an engine control system for a marine propulsion system and, more particularly, to a portable control device that performs the dual functions of allowing an operator of a marine vessel to start the engine of the marine propulsion system and simultaneously provide a safety system without the need for a physical tether connected between the operator and the marine vessel.

2. Description of the Prior Art

Those skilled in the art are familiar with handheld devices that can be used by the operator of an automobile to lock or unlock the doors of the vehicle from a distance. Typically, the handheld component is attached to an ignition key for the vehicle and is powered by a miniature battery. In addition to locking or unlocking the doors of the vehicle when the operator is at a distance from the vehicle, the portable component typically allows the operator to activate the automobile's horn. These processes are selected by the operator of the vehicle and are performed by depressing an appropriate push button on the handheld component.

Those skilled in the art are also aware of proximity badges that are used to selectively allow authorized personnel to unlock access doors of a building. These components are sometimes called RFID badges and typically do not require a power source in the badge itself. Instead, a sensor is rigidly mounted near the access door and periodically emits a signal that can be received by the badge. The badge operates as a transponder and a return signal is sensed by the sensor. If the signal is properly coded, the access door is unlocked to allow the authorized person to enter a particular zone or building. Other technologies have also been developed which allow a badge to be remotely sensed from a distance and be coded to determine whether or not access should be permitted to the wearer of the badge.

U.S. Pat. No. 6,476,708, which issued to Johnson on Nov. 5, 2002, describes a detection of an RFID device by an RF reader unit operating in a reduced power state. The method is provided for operating an RF transponder system to detect the presence of an RFID device in the proximal space of an RF reader unit having an excitation signal generator circuit and an RFID device detection circuit. The excitation signal generator circuit unit initially operates in a reduced power state, generating ring signals in response to a reduced electrical current and transmitting the ring signals into the proximal space. The RFID device detection circuit evaluates the ring signals to determine variations in an RFID device detection parameter. When the variations pass a variation threshold level due to the presence of the RFID device, the ring signals are terminated and the excitation signal generator circuit switches to an increased power state, wherein the excitation signal generator circuit generates an RF excitation signal which is transmitted to the RFID device.

U.S. Pat. No. 6,566,997, which issued to Bradin on May 20, 2003, describes an interference control method for RFID systems. A reader unit for use in a radio frequency identification (RFID) system delays the initiation of an interrogation operation when potentially interfering radio frequency (RF) energy is detected within an operational frequency range of the system. The reader unit waits a quasi-random period of time after the detection and then senses the spectral environment again to determine whether the energy is still present. If the energy is still present, the reader unit waits another quasi-random period and the process repeats. If there is no energy present or the energy is below a threshold value, the reader unit immediately initiates the interrogation operation. By delaying the initiation of the interrogation operation until the operative frequency range is free of potential interferers, the likelihood of harmful interference effects is significantly reduced.

U.S. Pat. No. 6,650,227, which issued to Bradin on Nov. 18, 2003, describes a reader for a radio frequency identification system having automatic tuning capability. A reader for an RFID system has an exciter circuit for generating an excitation signal and a feedback circuit coupled to the exciter circuit for automatically tuning the exciter circuit. The exciter circuit has at least one retunable component providing the exciter circuit with adjustable component values and a plurality of signal generating states. The exciter circuit is initially tuned to a first signal generating state, but is retunable to additional signal generating states by adjusting the component value of the retunable component. The feedback circuit includes a circuit evaluator coupled to the exciter circuit for determining a value of an operational parameter of the exciter circuit. A decision-making circuit is coupled to the circuit evaluator for formulating a decision in response to the value of the operational parameter. An adjustment circuit is coupled to the decision-making circuit and exciter circuit for receiving the decision and conveying an adjustment instruction to the exciter circuit in response to the decision.

U.S. Pat. No. 6,140,935, which issued to Hayton et al. on Oct. 31, 2000, describes an audio device security system. The audio device is installed in a motor vehicle with a vehicle security system. The radio has circuitry to detect a connection to the vehicle power supply, a microprocessor to inhibit the operation of the radio after an interruption of the connection, an interface and a connection to a bus for communicating data between the radio and the vehicle security system and a data verification unit with a non-volatile memory for verifying data communicated to the radio. Following an interruption of the connection the radio is automatically reset to operational if the data are communicated and verified, and if the data are not communicated or not verified the radio may only be reset manually.

U.S. Pat. No. 6,144,112, which issued to Gilmore on Nov. 7, 2000, describes a fuel pump immobilization device. The device relates to an apparatus and a method for a motor vehicle security system relating to immobilizing and enabling of a fuel pump for a motor vehicle engine. The system composes data input means for receiving drive verification data, an engine control unit including an ECU processor for controlling engine operation, a pump control unit including a PCU processor for controlling the fuel pump, the PCU being separate from the ECU and integrally housed with the fuel pump. Communication links permit communication between the data input means and ECU, and between the ECU and the PCU. The ECU processor is activated to control the PCU when valid driver verification data is received. The PCU processor is then activated to communicate a challenge code to the ECU. The ECU and PCU processors then compute respectively a first and a second response code associated with the challenge code. Finally, the PCU immobilizes the fuel pump until such time as the PCU receives from the ECU a first response code which matches the second response code computed by the PCU, whereupon the PCU is activated to control the fuel pump in response to the control of the ECU.

U.S. Pat. No. 5,396,215, which issued to Hinkle on Mar. 7, 1995, describes a vehicle operation inhibitor control apparatus. A band housing a transmitter is non-removably mounted about a portion of the body of a person who is not authorized to operate a motor vehicle. A receiver is mounted in the vehicle in close proximity to the vehicle steering wheel to detect signals from the transmitter when the person wearing the band is situated in proximity with the steering wheel. Upon receiving a signal from the transmitter, the receiver generates an output signal to electric circuit control elements which inhibit the operation of the vehicle.

U.S. Pat. No. 6,091,330, which issued to Swan et al. on Jul. 18, 2000, describes an integrated vehicle remote engine ignition system. A remotely controlled electrical accessory system for starting an engine of a vehicle and actuating a garage door opener attached to a garage door is described. The system includes a first transmitter for producing an engine ignition signal and a second transmitter for producing a garage door opener actuation signal. A receiver starts the engine of the vehicle and energizes the second transmitter to produce the garage door opener actuation signal in response to the engine ignition signal. In a preferred embodiment, the system includes a proximity sensor attached to the vehicle for producing a gating signal in response to a closed garage door. Preferably, the receiver starts the engine of the vehicle in response to the engine ignition signal and then energizes the second transmitter to produce the garage door opener actuation signal in response to the engine ignition signal and the gating signal.

U.S. Pat. No. 3,889,089, which issued to Tomlin on Jun. 10, 1975, describes an operation actuated ignition kill device. The device is intended for use with marine engines and particularly outboard marine engines which includes a tension member attached to the ignition key of the engine and a flexible wire connected to one end of the tension member, the other end of the flexible wire being attached to the operator of the boat, thereby providing a means by which the ignition will be forced into the "off" position if the operator is thrown from the boat.

U.S. Pat. No. 5,229,648, which issued to Sues et al. on Jul. 20, 1993, describes a multi element security system. The system is provided for a mobile piece of equipment such as a freight car, aircraft, boat, automotive/truck vehicle, or other machine that may be stolen. The system consists of a central processing unit, transporting a stream of data to various components of the vehicle, and component control units attached to each of the parts of the vehicle being protected. The control units accept a code from the memory of the vehicle ignition key, alter the code, and transmit the altered code back to the CPU. The operation of certain devices that effect the operation of the vehicle and/or its protected subsystems are also disabled. These systems in turn may be linked to a central database via a system control center to control the inventory and regulation of parts both within each vehicle and between all vehicles protected by the system.

U.S. Pat. No. 3,786,892, which issued to Horton on Jan. 22, 1974, describes a safety cut-off device for an ignition switch. The ignition switch cut-off device is intended for use in an open type carrier, for example a motor boat, to cut off the engine in the event that the operator is thrown out or falls out of the boat. The cut-off device comprises a control member to be supported in front of the keyhole of the ignition switch housing and having a slot for receiving the ignition switch key when the key is inserted into the keyhole. A housing means is provided for supporting the control member for rotational movement in front of the ignition switch keyhole to allow the key to be inserted through the slot into the ignition switch keyhole and to turn with the key when it is turned to its run and off positions. A flexible pull member is coupled to the control member and is adapted to extend out of the housing means in a manner such that when the key is at its run position and the pull member is pulled, the control member and hence the key will be pulled to its off position to cut off the motor. The pull member is adapted to be coupled to the operator.

U.S. Pat. No. 6,450,845, which issued to Snyder et al. on Sep. 17, 2002, discloses a passive occupant sensing system for a watercraft. A tetherless occupant detector system uses an infrared sensor and a monitor circuit that provides a deactivation signal to an engine control unit or other control mechanisms in the event of an operator of the marine vessel leaving a preselected control position at its helm. The infrared sensor provides an output signal that is generally representative of the heat produced by an occupant within the control position of a marine vessel. The monitor circuit reacts to a sudden decrease in this heat magnitude and provides a deactivation signal in response to detecting this sudden decrease. The deactivation signal provided by the monitor circuit can be received by an engine control unit which then, in turn, deactivates a marine propulsion system. Alternatively, the deactivation signal itself can cause a deactivation of the marine propulsion system.

The patents described above are hereby expressly incorporated by reference in the description of the preferred embodiment of the present invention.

Marine vessels, unlike land vehicles, typically do not provide lockable doors to prevent unauthorized entry onto the marine vessel, or boat. It would therefore be beneficial if some means could be provided to prevent unauthorized operation of the marine vessel. In addition, the key controlled engine activation system of a marine vessel is often subjected to corrosive environments and can malfunction. Similarly, it would be beneficial if a system can be provided to deactivate the engine of the marine vessel if the operator is thrown from the vessel or from the seat at the helm. If a system could be provided which addresses all of these situations, the security of the vessel and the safety of the operator could be significantly enhanced.

SUMMARY OF THE INVENTION

An engine control system for a marine propulsion system, made in accordance with a preferred embodiment of the present invention, comprises an engine activation system and a portable control device which is configured to emit a first signal in response to a manual actuation. An ignition activation system is connected in signal communication with an engine activation system of an engine of the marine propulsion system. A first sensor, connected in signal communication with the ignition activation system of the marine propulsion system, is provided for sensing the first signal from the portable control device and placing the ignition activation system in either a first starting state or a second starting state as a function of the first signal. A second sensor is connected in signal communication with the engine activation system for sensing a second signal emitted by the portable control device. The portable control device is configured to emit the second signal when it is within a predetermined distance of the second sensor. The second sensor is configured to place the engine activation system in either a first operating state or a second operating state as a function of the second signal. In alternative embodiments of the preferred embodiment of the present invention, the second sensor is configured to place the engine in either a first operating state or the second state as a function of the second signal. Although it is recognized that a similar result can be obtained by using the engine activation system to enable or disable the operation of the internal combustion engine, it is also recognized that alternative systems can be used to actually start the engine by activating a starting sequence or stop the engine's operation. In other words, the preferred embodiment of the present invention can place the system in an "armed" or "ready" state or it can actually energize a starter motor to start the engine.

The preferred embodiment of the present invention can comprise a transponder embedded within the portable control device. The transponder can be configured to emit the second signal in response to a condition caused by the second sensor when the portable control device is within the predetermined distance of the second sensor. The first starting state can comprise an energization of a starting motor of the engine activation system to rotate a crankshaft of the engine and the second starting state can comprise a de-energization of the starting motor of the engine activation system. The first starting state can alternatively be a state in which the ignition activation system is allowed to be initiated by a manually activated switch. In other words, the first starting state can enable the starting of the marine propulsion system by the use of a manually activated switch, wherein the second starting state would not arm the ignition activation system to allow it to be started by the manually activated switch.

The first operating state is a state in which the engine is operable and the second operating state is a state in which the engine is inoperable. The second operating state can result in response to the portable control device being further than the predetermined distance from the second sensor. The second operating state can be a state in which the engine is inoperable if a gear selector is not in a neutral gear position. The first and second sensors can be disposed in separate housings and the portable control device can be attachable to an operator of the marine propulsion system. The first sensor can be attached to a dashboard of the marine vessel.

BRIEF DESCRIPTION OF THE DRAWINGS

The preferred embodiment of the present invention will be more fully and completely understood from a reading of the description of the preferred embodiment in conjunction with the drawings, in which.

DESCRIPTION OF THE PREFERRED EMBODIMENT

Figure 1:
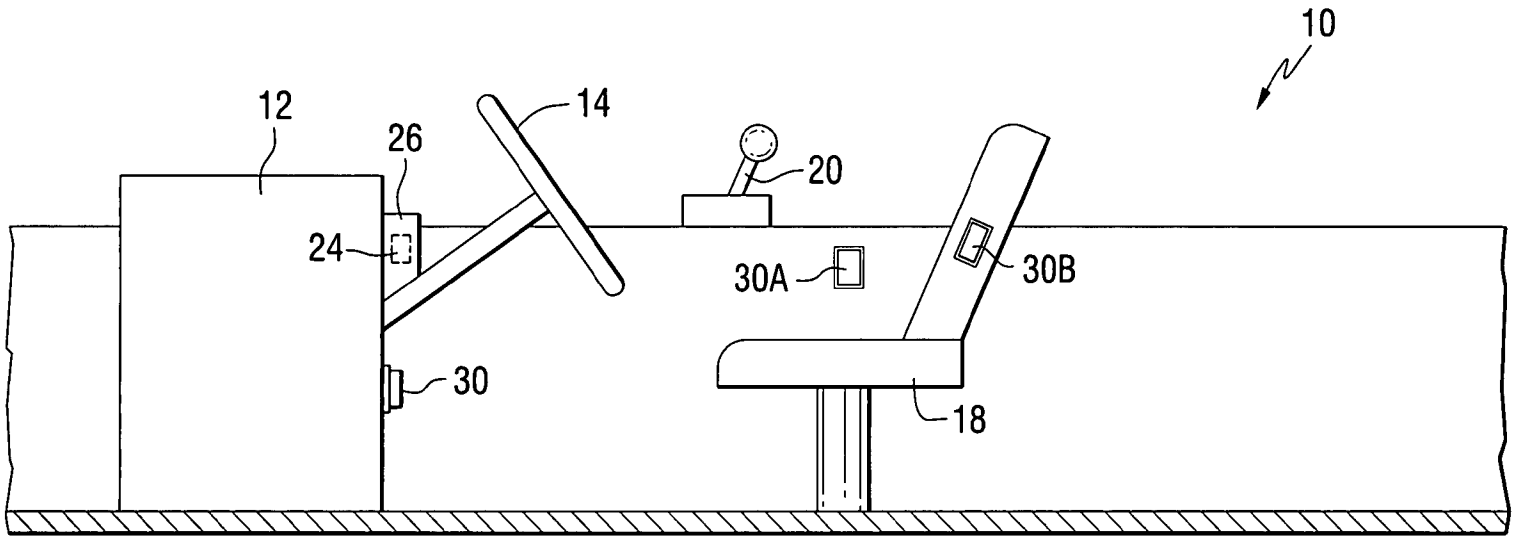
FIG. 1 is a simplified representation of a marine vessel helm position.

Throughout the description of the preferred embodiment of the present invention, like components will be identified by like reference numerals.

FIG. 1 is a schematic representation of a marine vessel 10 at which a helm location has a console 12, a steering wheel 14, and a seat 18 at which the operator of the marine vessel can sit while controlling the operation of the marine vessel. A throttle handle 20 is provided to allow the operator to select either forward, neutral, or reverse gear position and also to select the operating speed of an engine of the marine vessel 10. Throttle handles are well known for use in conjunction with marine propulsion systems and will not be described in greater detail herein.

A first sensor 24 is connected in signal communication with an ignition activation system 26 of the marine propulsion system. The first sensor is configured to sense a first signal from a portable control device, which will be described in greater detail below, to place the ignition activation system 26 in either a first starting state or a second starting state as a function of the first signal. A second sensor 30 is connected in signal communication with the engine activation system for sensing a second signal emitted by the portable control device. Although the preferred embodiment of the present invention will be described below in terms of an ignition system, it should be understood that alternative forms of engine activation and deactivation systems are also within its scope. For example, a fuel supply system could be modified for these purposes. The portable control device is configured to emit the second signal when it is within a predetermined distance of the second sensor 30. The second sensor 30 is configured to place the engine activation system in either a first operating state or a second operating state as a function of the second signal.

With continued reference to FIG. 1, positions 30A and 30B are illustrated for showing alternative locations for the second sensor 30.

Figure 2:
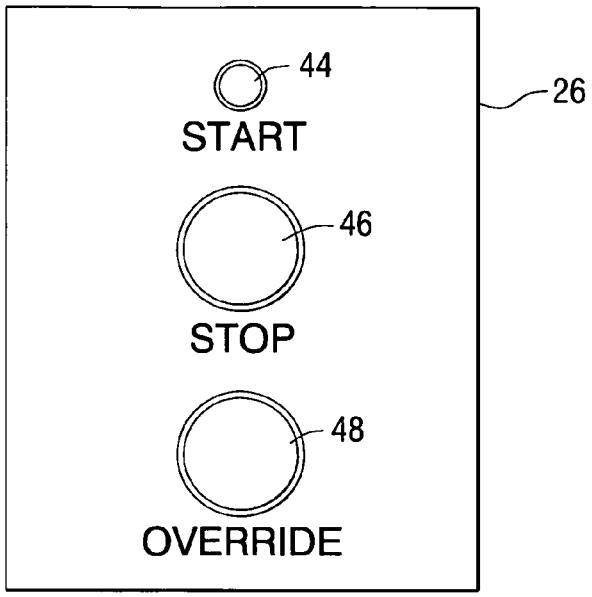
FIG. 2 shows the ignition activation system of the preferred embodiment of the present invention.
Figure 3:
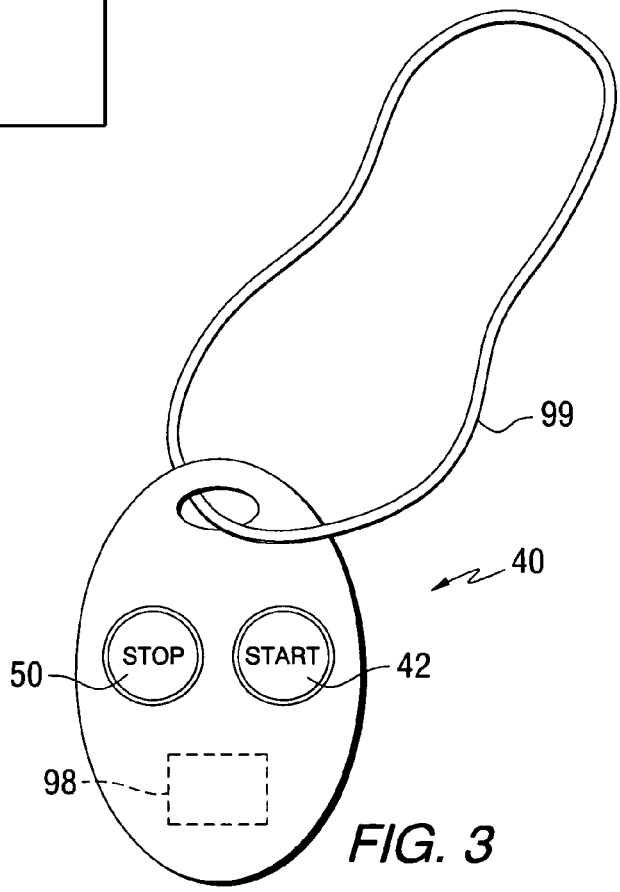
FIG. 3 shows the portable control device used in conjunction with a preferred embodiment of the present invention.

FIG. 2 shows an ignition activation system 26 which is connected in signal communication with the first sensor. FIG. 3 shows the portable control device 40. Certain embodiments of the preferred embodiment of the present invention can be configured to start the engine when the operator of the marine vessel presses the start button 42 on the portable control device 40. Alternatively, the start button 42 can be used to arm the ignition activation system 26 so that a subsequent pressing of a start button 44 of the ignition activation system 26, mounted on the dashboard of the console 12, would actually energize the starting motor to start the engine. The ignition activation system 26 would also comprise a stop button 46 and an override button 48 which will be described in greater detail below. The stop button 50 on the portable control device 40 could be used to de-energize the operation of the engine. In other words, the engine can be stopped by either pressing the stop button 46 that is part of the ignition activation system 26 on the dashboard of the console 12 or pressing the stop button 50 which is on the portable control device 40.

Figure 4:
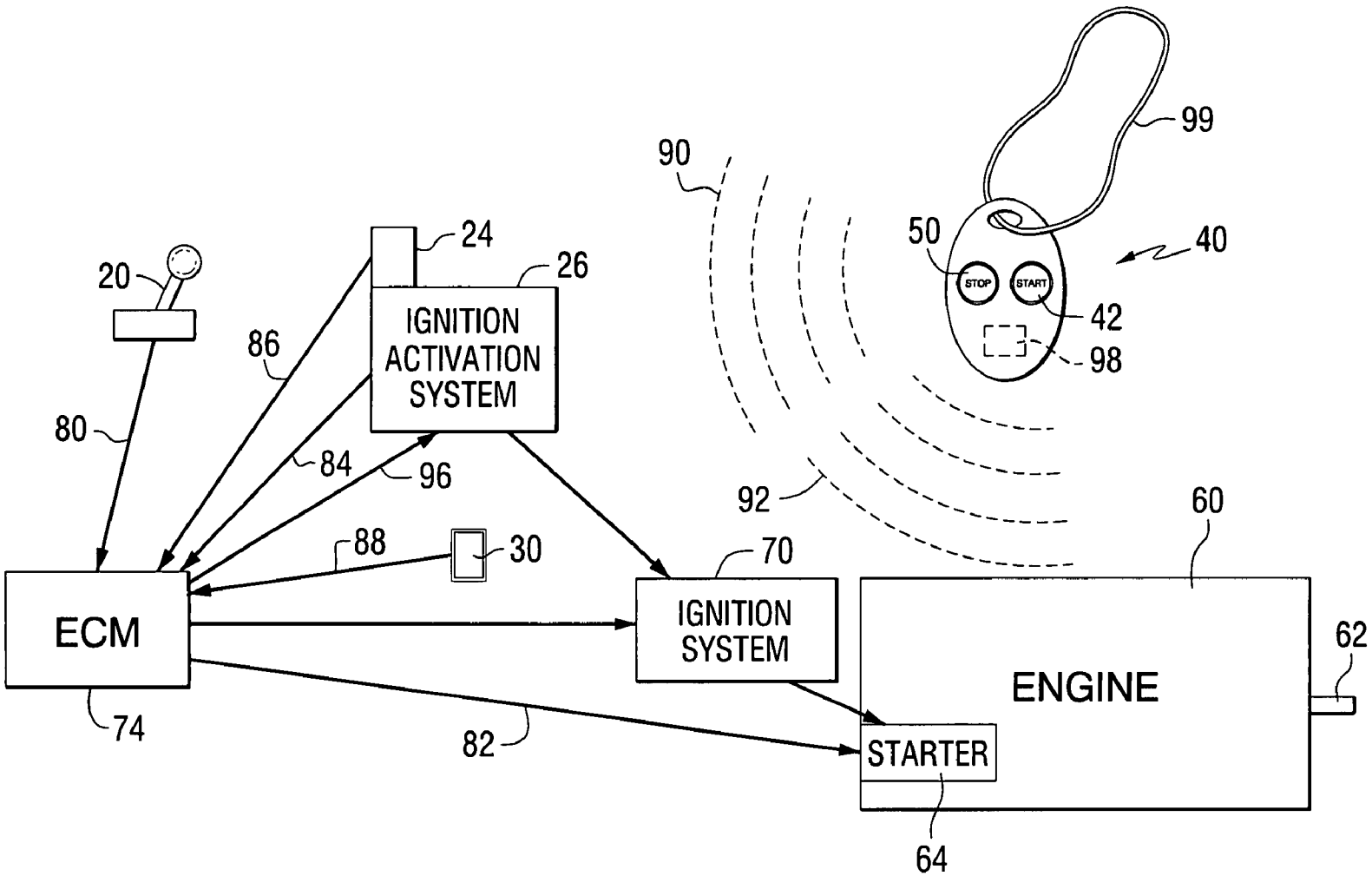
FIG. 4 is a schematic representation of a marine vessel propulsion system incorporating the preferred embodiment of the present invention.

FIG. 4 is a schematic representation of a marine propulsion system incorporating the preferred embodiment of the present invention. An engine 60 is provided as the source of power for a marine vessel. The engine 60 has a crankshaft 62 and a starter 64 which typically comprises an electric motor that is connected in torque transferring communication with a crankshaft 62. An engine activation system 70 comprises the necessary components to provide power to the starter motor 64. The engine activation system 70, or ignition system, includes a power source, such as a battery, and the appropriate switches and conductors necessary to provide power to the starter 64 when the operator of the marine vessel desires to start the engine 60.

In the illustration of FIG. 4, an engine control module 74 is shown. The engine control module typically comprises a microprocessor that is appropriately programmed to receive signals and to transmit signals to various components of the marine propulsion system. Although it should be understood that the components shown in FIG. 4 can be connected in signal communication with each other in a variety of ways, the interrelationship shown in FIG. 4 is one that is used on certain marine vessels. The throttle handle 20 provides a set of signals to the engine control module 74, as represented by arrow 80, relating to the position of the handle 20. In turn, the engine control module 74 provides signals, as represented by arrow 82, to the engine 60. The engine control module 74 can also receive signals from the ignition activation system 26, as represented by arrow 84, which relate to various switches that can be manually manipulated. In other words, if the operator of the marine vessel presses the start button 44, as described above in conjunction with FIG. 2, the signal would be transmitted to the engine control module 74 so that it can take an appropriate action. In addition, the first sensor 24 provides a signal to the engine control module, as represented by arrow 86, relating to the receipt of the first signal which is represented by dashed lines 90 in FIG. 4. The second sensor 30 is configured to receive the second signal, represented by dashed lines 92 in FIG. 4, and provide that information to the engine control module 74, as represented by arrow 88. It should be understood that the preferred embodiment of the present invention allows various embodiments that can be applied with respect to the second sensor 30. For example, the engine control module 74 can be configured to require that the transponder 98 be within the predetermined distance from the second sensor 30 as long as the handle 20 is in either forward or reverse gear position. In this embodiment, the engine control module 74 would not immediately stop the engine 60 even if the portable control device 40 is moved away from the predetermined zone within which the second sensor 30 can receive the second signal 92. Alternative embodiments could require that the portable control device 40 be within the transmitting zone of the second sensor 30 regardless of the position of handle 20. In certain circumstances, it may be desirable that the engine control module 74 allow the operator to momentarily move out of the detection zone of the second sensor 30 as long as the handle 20 is in the neutral gear position and the operator presses the override button 48 that is associated with the ignition activation system. In addition to these two alternative embodiments, it should be understood that additional techniques and procedures can be employed within the scope of the preferred embodiment of the present invention.

With continued reference to FIG. 4, the engine control module 74 can provide a start signal, as represented by arrow 96, to the ignition activation system 26 when it receives a signal from the first sensor 24.

With reference to FIGS. 1–4, the preferred embodiment of the present invention provides an engine control system for a marine propulsion system that comprises an engine activation system 70, a portable control device 40 which is configured to emit a first signal 90 in response to a manual actuation, such as by depressing the start button 42, and an ignition activation system 26 that is connected in signal communication with an engine activation system, which can be an ignition system, ignition system 70 of an engine 60 of the marine propulsion system. A first sensor 24 is connected in signal communication with the ignition activation system 26 of the marine propulsion system and is used for sensing the first signal 90 from the portable control device 40 and placing the ignition activation system 26 in either a first starting state or a second starting state as a function of the first signal 90. The preferred embodiment of the present invention can be configured to immediately start the engine 60 by activating the starter 64 when the first signal 90 is received by the first sensor 24. The engine control module 74, in a typical application of the preferred embodiment of the present invention, would first determine whether or not the throttle handle 20 is in a neutral gear position so that the marine vessel isn't inadvertently caused to move forward when the engine 60 is started. In an alternative embodiment of the preferred embodiment of the present invention, receipt of the first signal 90 by the first sensor 24 would place the ignition activation system 26 in a ready state, equivalent to turning an ignition key to the "on" position, after which the operator of the marine vessel would be allowed to push the start button 44. When the ignition activation system 26 is armed in this way, the engine control module 74 would respond to a manual activation of the start switch 44. If the portable control device 40 was not used to arm the ignition activation system 26, by first depressing the start button 42, a subsequent manual activation of the start button 44 of the ignition activation system 26 would be ignored. It should therefore be understood that the response to the activation of the start button 42 on the portable control device 40 can be an immediate starting of the engine 60 if the handle 20 is in neutral position or, alternatively, it can be an arming of the ignition activation system 26 to permit a subsequent starting of the engine 60 when the operator presses the start button 44 of the ignition activation system. This aspect of the preferred embodiment of the present invention involves the interaction between the start button 42 on the portable control device 40 and the first sensor 24 which is connected in signal communication with the ignition activation system 26, either directly or logically through the engine control module 74.

With continued reference to FIGS. 1–4, the portable control device 40 is also configured to emit the second signal 92 when it is within a predetermined distance of the second sensor 30. The second signal 92 can be sent by a transponder 98 in a manner that is generally similar to the method by which a proximity badge operates in cooperation with an RFID transmitter/receiver. In an application of this type, the second sensor 30 periodically transmits a signal that is effective within a predetermined distance of the second sensor 30. When that signal is received by the portable control device 40, a return signal is sent by the transponder 98 and received by the second sensor 30. This verifies that the portable control device 40 is within the predetermined distance of the second sensor 30. The second sensor 30 is connected in signal communication with the ignition system 70, either directly or logically through the engine control module 74. The engine control module can then control the operation of the engine 60 as a function of the presence or absence of the portable control device 40 and, more particularly, the transponder 98, within the predetermined distance from the second sensor 30. In this way, the portable control device 40 can be used as a tetherless safety switch that turns the engine 60 off when the portable control device 40 is not within the predetermined distance of the second sensor 30.

With continued reference to FIGS. 1–4, the transponder 98 can be embedded with the portable control device 40 and configured to emit the second signal 92 in response to a condition caused by the second sensor 30 when the portable control device is within the predetermined distance of the second sensor. The first starting state can comprise an immediate energization of the starting motor 64 of the ignition system 70 to rotate the crankshaft 62 of the engine 60. Accordingly, the second starting state would comprise a de-engerization of the starting motor 64 of the ignition system 70. Alternatively, the first starting state can be a state in which the ignition activation system 26 is armed in a manner that allows it to be initiated by a manually activated start switch 44.

The first operating state can be a state in which the engine 60 is operable and the second operating state can be a state in which the engine 60 is inoperable. In other words, the engine 60 can be made inoperable by opening a switch in the ignition system 70 to deprive the engine 60 of necessary electrical power. The second operating state can be initiated in response to the portable control device 40 being farther than the predetermined distance from the second sensor 30. The second operating state can be a state in which the engine 60 is inoperable as long as the gear selector 20 is not in a neutral gear position. In other words, if the operator of the marine vessel, with the portable control device 40 attached to the operator, leaves the helm position of the marine vessel, the engine 60 can be allowed to continue operating as long as the throttle handle 20 is in a neutral gear position. This is possible since the operator's leaving the helm position with the transmission in neutral gear position does not represent an immediate danger and does not likely mean that the operator was thrown from the vessel since the gear position is in neutral. Alternatively, if the throttle handle 20 is in either forward or reverse position and the portable control device 40 is not within the predetermined distance of the second sensor 30, the engine 20 would be stopped by making it inoperable which is the second operating state described above.

The first and second sensors, 24 and 30, can be disposed in separate housings from each other or, alternatively, they can both be located in a common housing such as the ignition activation system housing shown in FIG. 1. In addition, a plurality of second sensors can be used so that the operator of the marine vessel is allowed a certain degree of movement within the zone of the helm. The portable control device 40 is attachable to an operator of the marine propulsion engine. This attachability is represented by a loop 99 that allows the portable control device 40 to be worn either around the wrist or neck of the operator of the marine vessel. Alternatively, the portable control device can simply be carried in the pocket of the boat operator. The first sensor 24 can be incorporated within a common housing with the ignition activation system 26 and this common housing can be attached to the dashboard of a marine vessel.

With continued reference to FIGS. 1–4, it can be seen that the preferred embodiment of the present invention serves two valuable purposes through the use of a single portable control device 40. The first useful service pertains to the starting system of the marine vessel and it provides a level of security by which the marine vessel cannot be started without the use of the portable control device 40. In other words, the boat cannot be started through the use of an ignition key system that affords the possibility of being tampered with in an attempt to steal the boat. By requiring the depression of the start button 42 on the portable control device 40, an added level of security is provided to prevent, or at least discourage, theft of the marine vessel. The second important function performed by the preferred embodiment of the present invention is the provision of a tetherless safety switch that disables the engine 60 when the operator, wearing the portable control device 40, leaves the helm position. As described above, this second feature of the preferred embodiment of the present invention can be used in conjunction with software in the engine control module 74 in which the operator can be allowed to leave the helm position as long as the throttle handle 20 is in a neutral gear position. Otherwise, the engine 60 would immediately be made inoperable. The preferred embodiment of the present invention can replace less reliable mechanical ignition switches with sealed or solid state control switches and sensors.

Although the preferred embodiment of the present invention has been described in particular detail to illustrate a preferred embodiment, it should be understood that alternative embodiments are also within its scope.

I claim:

1. An engine control system for a marine propulsion system, comprising:

an ignition system;

a portable control device configured to emit a first signal in response to a manual actuation;

an ignition activation system connected in signal communication with said ignition system of said marine propulsion system;

a first sensor, connected in signal communication with said ignition activation system of said marine propulsion system, for sensing said first signal from said portable control device and placing said ignition activation system in either a first starting state or a second starting state as a function of said first signal; and a second sensor, connected in signal communication with said ignition system, for sensing a second signal emitted by said portable control device, said portable control device being configured to emit said second signal when it is within a predetermined distance of said second sensor, said second sensor being configured to place said engine in either a first operating state or a second operating state as a function of said second signal.

2. The control system of claim 1, further comprising:

a transponder embedded within said portable control device, said transponder being configured to emit said second signal in response to a condition caused by said second sensor when said portable control device is within said predetermined distance of said second sensor.

3. The control system of claim 1, wherein:

said first starting state comprises an energization of a starting motor of said ignition system to rotate a crankshaft of said engine and said second starting state comprises a de-energization of said starting motor of said ignition system.

4. The control system of claim 1, wherein:

said first starting state is a state in which said ignition activation system is initiated by a manually activated switch.

5. The control system of claim 1, wherein:

said first operating state is a state in which said engine is operable and said second operating state is a state in which said engine is inoperable.

6. The control system of claim 5, wherein:

said second operating state is in response to said portable control device being farther than said predetermined distance from said second sensor.

7. The control system of claim 5, wherein:

said second operating state is a state in which said engine is inoperable when a gear selector is not in a neutral gear position.

8. The control system of claim 1, wherein:

said first and second sensors are disposed in separate housings from each other.

9. The control system of claim 1, wherein:

said portable control device is attachable to an operator of said marine propulsion system.

10. The control system of claim 1, wherein:

said first sensor is attached to a dashboard of a marine vessel.

11. An engine control system for a marine propulsion system, comprising:

an ignition system;

a portable control device configured to emit a first signal in response to a manual actuation;

an ignition activation system connected in signal communication with said ignition system of said marine propulsion system;

a first sensor, connected in signal communication with said ignition activation system of said marine propulsion system, for sensing said first signal from said portable control device and placing said ignition activation system in either a first starting state or a second starting state as a function of said first signal, said first starting state comprising an energization of a starting motor of said ignition system to rotate a crankshaft of said engine and said second starting state comprising a de-energization of said starting motor of said ignition system; and a second sensor, connected in signal communication with said ignition system, for sensing a second signal emitted by said portable control device, said portable control device being configured to emit said second signal when it is within a predetermined distance of said second sensor, said second sensor being configured to place said engine in either a first operating state or a second operating state as a function of said second signal.

12. The control system of claim 11, further comprising:

a transponder embedded within said portable control device, said transponder being configured to emit said second signal in response to a condition caused by said second sensor when said portable control device is within said predetermined distance of said second sensor.

13. The control system of claim 11, wherein:

said first operating state is a state in which said engine is operable and said second operating state is a state in which said engine is inoperable.

14. The control system of claim 13, wherein:

said second operating state is in response to said portable control device being farther than said predetermined distance from said second sensor.

15. The control system of claim 14, wherein:

said second operating state is a state in which said engine is inoperable when a gear selector is not in a neutral gear position.

16. The control system of claim 15, wherein:

said first and second sensors are disposed in separate housings from each other and said portable control device is attachable to an operator of said marine propulsion system.

17. An engine control system for a marine propulsion system, comprising:

an ignition system;

a portable control device configured to emit a first signal in response to a manual actuation;

an ignition activation system connected in signal communication with said ignition system of said marine propulsion system;

a first sensor, connected in signal communication with said ignition activation system of said marine propulsion system, for sensing said first signal from said portable control device and placing said ignition activation system in either a first starting state or a second starting state as a function of said first signal, said first starting state being a state in which said ignition activation system can be initiated by a manually activated switch; and a second sensor, connected in signal communication with said ignition system, for sensing a second signal emitted by said portable control device, said portable control device being configured to emit said second signal when it is within a predetermined distance of said second sensor, said second sensor being configured to place said engine in either a first operating state or a second operating state as a function of said second signal, said first operating state being a state in which said engine is operable and said second operating state is a state in which said engine is inoperable.

18. The control system of claim 17, further comprising:

a transponder embedded within said portable control device, said transponder being configured to emit said second signal in response to a condition caused by said second sensor when said portable control device is within said predetermined distance of said second sensor.

19. The control system of claim 18, wherein:

said second operating state is in response to said portable control device being farther than said predetermined distance from said second sensor.

20. The control system of claim 19, wherein:

said second operating state is a state in which said engine is inoperable when a gear selector is not in a neutral gear position.

* * * * *